US007912395B2

(12) United States Patent
Yamada

(10) Patent No.: US 7,912,395 B2
(45) Date of Patent: Mar. 22, 2011

(54) MONITORING APPARATUS AND MONITORING SYSTEM FOR IMAGE FORMING APPARATUS AND CONTROL METHOD FOR MONITORING APPARATUS AND MONITORING SYSTEM

(75) Inventor: Tetsuya Yamada, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 525 days.

(21) Appl. No.: 12/028,136

(22) Filed: Feb. 8, 2008

(65) Prior Publication Data

US 2008/0193146 A1 Aug. 14, 2008

(30) Foreign Application Priority Data

Feb. 8, 2007 (JP) ..... 2007-029354

(51) Int. Cl.
*G03G 15/00* (2006.01)
*G03G 21/00* (2006.01)

(52) U.S. Cl. ..... 399/79; 399/8; 399/80; 399/366

(58) Field of Classification Search ..... 399/8, 9, 399/75, 79, 80, 366
See application file for complete search history.

(56) References Cited

U.S. PATENT DOCUMENTS

| | | | | |
|---|---|---|---|---|
| 7,340,194 | B2 * | 3/2008 | Ozawa | 399/79 |
| 7,386,246 | B2 * | 6/2008 | Yabe | 399/82 |
| 7,609,952 | B2 * | 10/2009 | Jezierski et al. | 396/56 |
| 2005/0111867 | A1 * | 5/2005 | Hatano | 399/80 |
| 2005/0214016 | A1 * | 9/2005 | Ozawa | 399/79 |

FOREIGN PATENT DOCUMENTS

| | | | |
|---|---|---|---|
| JP | 7-44777 | A | 2/1995 |
| JP | 11-194687 | A | 7/1999 |
| JP | 2005142991 | A * | 6/2005 |

* cited by examiner

*Primary Examiner* — David M Gray
*Assistant Examiner* — Fred Braun
(74) *Attorney, Agent, or Firm* — Canon USA Inc IP Division

(57) ABSTRACT

A monitoring apparatus and a monitoring system monitor a person who removed an output sheet for a print job or a copy job from an image forming apparatus that can be used by a plurality of users. With the use of a job-start notification, a job-end notification, and a sheet-removal notification received from the image forming apparatus, a video image during a period including the time at which the sheet output from the image forming apparatus was removed by a person can be recorded, and the video image can be managed in association with job information.

15 Claims, 8 Drawing Sheets

MONITORING APPARATUS AND MONITORING SYSTEM FOR IMAGE FORMING APPARATUS AND CONTROL METHOD FOR MONITORING APPARATUS AND MONITORING SYSTEM

BACKGROUND OF THE INVENTION

1. Field of the Invention

The present invention relates to a monitoring system and a monitoring apparatus for causing a monitoring camera to capture and record a video image of an image forming apparatus in order to determine whether a material output from the image forming apparatus has been removed by a person who instructed performance of an output operation for the output material or by a person who did not instruct performance of the output operation, and to control methods for the monitoring system and the monitoring apparatus.

2. Description of the Related Art

An image forming apparatus that is used as a multifunction machine provided with a printing function for receiving print jobs from a personal computer (PC) and performing printing, a copy function, and the like is available. Such an image forming apparatus is connected to a network and can be shared, as a common printer, among a plurality of users. Since the image forming apparatus can be used by a plurality of users both when used as a printer and when used as a copying machine, an administrator may monitor the use status of the image forming apparatus.

A system for, when a copying machine connected to a monitoring camera determines, using pattern matching, that a document is a particular copy-inhibited document, inhibiting copying of the document and starting video image capturing using the monitoring camera is described in Japanese Patent Laid-Open No 7-44777.

For an image forming apparatus that can be used by a plurality of users, a material output from the image forming apparatus may be removed by a person who is different from a user who instructed performance of an output operation for a corresponding print job or copy job. In particular, it is undesirable that such a problem occurs when an output material contains confidential information or private information.

SUMMARY OF THE INVENTION

The present invention provides a monitoring apparatus and a monitoring system for monitoring a person who removed an output sheet for a print job or a copy job from an image forming apparatus that can be used by a plurality of users. With the use of a job-start notification, a job-end notification, and a sheet-removal notification received from the image forming apparatus, a video image during a period including the time at which the sheet output from the image forming apparatus was removed by a person can be recorded, and the video image can be managed in association with job information.

According to a first aspect of the present invention, a monitoring apparatus connected to a monitoring camera capable of monitoring a user of an image forming apparatus through a communication medium includes a job-start-notification reception unit configured to receive a job-start notification from the image forming apparatus; a sheet-removal-notification reception unit configured to receive a sheet-removal notification from the image forming apparatus; and a monitor-video-image recording unit configured to acquire a video image captured by the monitoring camera and to record the video image as a monitor video image. The monitoring apparatus causes the monitor-video-image recording unit to start recording of the video image in response to the job-start notification received by the job-start-notification reception unit. The monitoring apparatus causes the monitor-video-image recording unit to stop the recording of the video image in response to the sheet-removal notification received by the sheet-removal-notification reception unit and manages the monitor video image recorded by the monitor-video-image recording unit in association with job information contained in the job-start notification.

According to a second aspect of the present invention, a monitoring system includes an image forming apparatus capable of performing copying or printing; a monitoring camera capable of capturing a video image of a user of the image forming apparatus; and a monitoring apparatus for controlling the monitoring camera. The image forming apparatus includes a job-start-notification transmission unit configured to, when the image forming apparatus receives a job and starts an image forming operation, transmit a job-start notification containing job information to the monitoring apparatus, and a sheet-removal-notification transmission unit configured to, when the image forming apparatus completes the image forming operation and detects that an output sheet has been removed from a sheet output portion, transmit a sheet-removal notification to the monitoring apparatus. The monitoring apparatus includes a job-start-notification reception unit configured to receive the job-start notification from the image forming apparatus, a sheet-removal-notification reception unit configured to receive the sheet-removal notification from the image forming apparatus, and a monitor-video-image recording unit configured to acquire the video image captured by the monitoring camera and to record the video image as a monitor video image. The monitoring apparatus causes the monitor-video-image recording unit to start recording of the video image in response to the job-start notification received by the job-start-notification reception unit. The monitoring apparatus causes the monitor-video-image recording unit to stop the recording of the video image in response to the sheet-removal notification received by the sheet-removal-notification reception unit and manages the monitor video image recorded by the monitor-video-image recording unit in association with the job information.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE EMBODIMENTS

Figure 1:
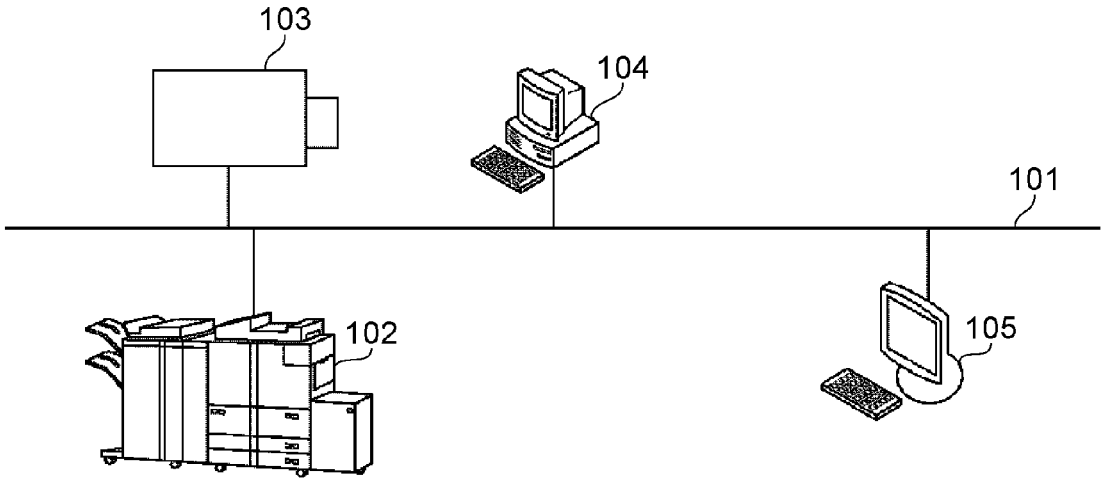
FIG. 1 shows the configuration of a system according to an embodiment of the present invention.

Embodiments of the present invention will now be described in detail in accordance with the accompanying drawings.

In the description of the embodiments, unless it is not particularly specified, same or similar parts throughout the embodiments are represented by the same reference numerals, and the description of those same or similar parts will not be repeated.

Component parts described in the embodiments are merely provided exemplarily. Such component parts do not limit the scope of the present invention.

A configuration of an embodiment of the present invention will be described.

System Configuration

FIG. 1 is a block diagram showing the entire configuration of an image-forming-apparatus monitoring system according to an embodiment of the present invention. Referring to FIG. 1, the image-forming-apparatus monitoring system includes an image forming apparatus 102, a monitoring camera 103, a monitoring system control apparatus 104, and a client PC 105. The image forming apparatus 102, the monitoring camera 103, the monitoring system control apparatus 104, and the client PC 105 are connected to each other via a network (local-area network (LAN)) 101, which is a communication medium.

The image forming apparatus 102 has a copying function, a printing function, a facsimile function, a transmission function, and the like. The image forming apparatus 102 is capable of image forming operations, including outputting of an image obtained by scanning by a scanner, outputting of a print job issued from the client PC 105, and outputting a facsimile/transmission job transmitted through a public line.

Configuration of Image Forming Apparatus

Figure 2:
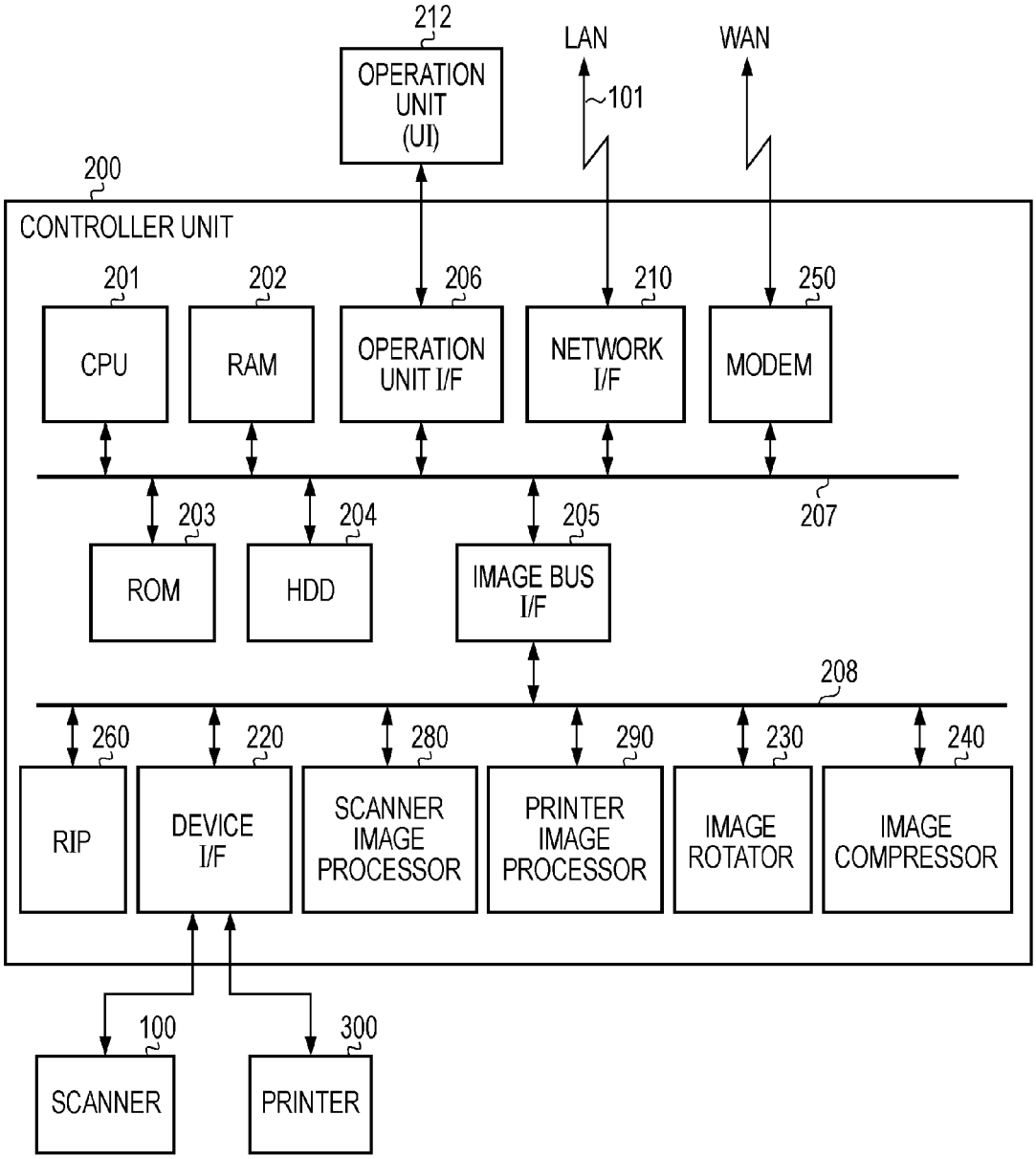
FIG. 2 shows the configuration of an image forming apparatus according to the embodiment.

FIG. 2 shows the configuration of a controller unit 200 of the image forming apparatus 102. The controller unit 200 is connected to a scanner 100, which is an image input device, and a printer 300, which is an image output device. The controller unit 200 is also connected to a LAN or a wide-area network (WAN), so that the controller unit 200 can input and output image information and device information.

A central processing unit (CPU) 201 controls the image forming apparatus 102. A random-access memory (RAM) 202 serves as a system work memory to be used for an operation of the CPU 201. The RAM 202 also serves as an image memory for temporarily storing image data. A read-only memory (ROM) 203 is a boot ROM. A boot program for the system is stored in the ROM 203. System software and image data are stored in a hard disk drive (HDD) 204.

An operation interface (I/F) 206 is an interface for an operation unit (UI) 212. The operation I/F 206 outputs display image data to the operation unit 212. The operation I/F 206 transmits to the CPU 201 information entered by a user through the operation unit 212.

A network interface 210 controls connection with the network (LAN) 101 and performs inputting and outputting of information from and to the network (LAN) 101. A modem 250 controls connection with a public line and performs inputting and outputting of information from an to the public line. The above-mentioned devices are arranged on a system bus 207.

An image bus interface (image bus I/F) 205 is a bus bridge that connects the system bus 207 to an image bus 208 for transmitting image data at high speed and performs conversion of a data structure. The image bus 208 is, for example, a peripheral component interconnect (PCI) bus or IEEE 1394.

The image bus 208 has a raster image processor (RIP) 260, a device IF unit 220, a scanner image processor 280, a printer image processor 290, an image rotator 230, and an image compressor 240 thereon. The RIP 260 expands a page description language (PDL) code transmitted through the network into a bitmap image. The device IF unit 220 connects the scanner 100 and the printer 300, which are image input and output devices, to the controller unit 200, so that conversion of image data can be achieved. The device IF unit 220 receives information related to various sensors provided in the scanner 100 and the printer 300, and transmits the received information to the operation unit 212 and the like.

The scanner image processor 280 performs correction, manipulation, and editing on input image data. The printer image processor 290 performs correction, resolution conversion, and the like corresponding to the performance of the printer 300. The image rotator 230 rotates image data. The image compressor 240 performs JPEG compression/decompression for multi-valued image data and performs Joint Bi-level Image Experts Group (JBIG), Modified Modified Read (MMR), or (Modified Huffman) MH compression/decompression for binary image data.

Figure 3:
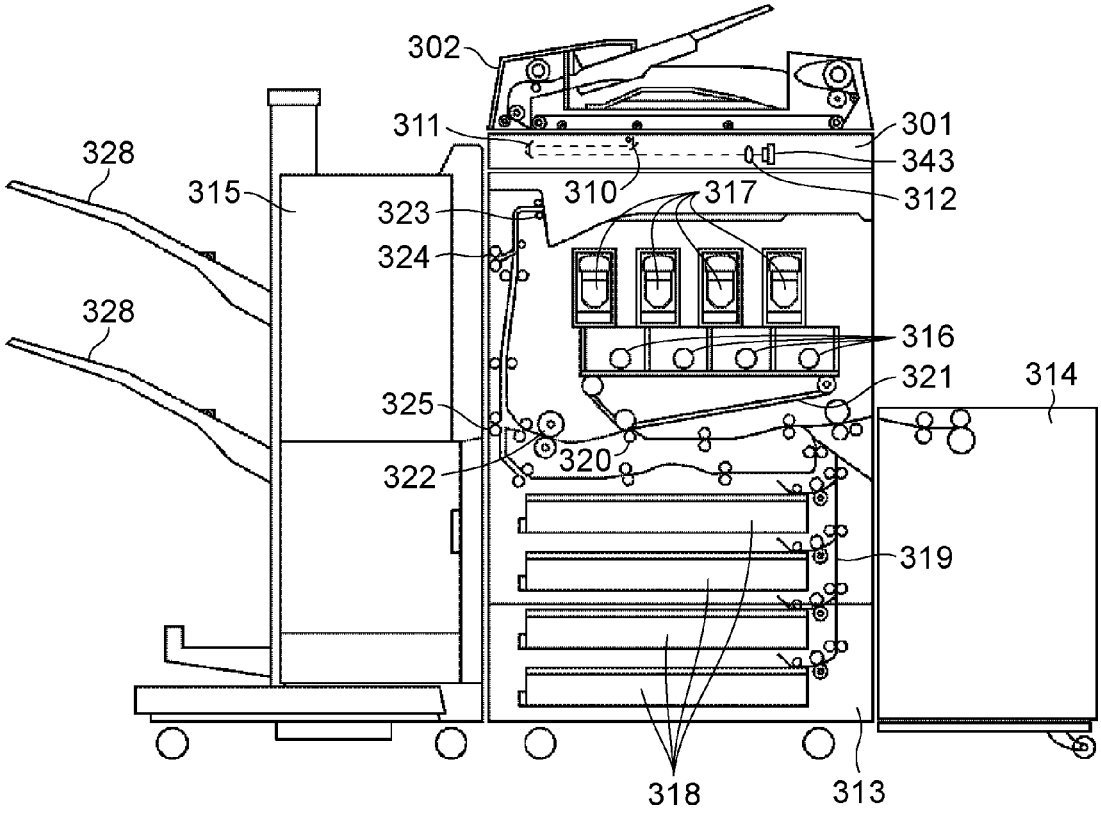
FIG. 3 is a sectional view of the image forming apparatus according to the embodiment.

FIG. 3 illustrates a cross section of the image forming apparatus 102. The image forming apparatus 102 includes a scanner 301, a document feeder (DF) 302, a print engine 313 including four-color drums and used for printing and recording, a sheet supply deck 314, and a finisher 315.

The scanner 301, which serves as an image input device, irradiates a document by a light source 310. A charge-coupled device (CCD) 343 reads an image through a reflector 311 and a lens 312. Then, the read image is converted into a digital signal. The digital signal is subjected to desired image processing and is converted into a laser recording signal. The resultant recording signal is stored in a memory.

The recording signal (print image data) stored in the memory is transferred to the print engine 313. A laser recording unit converts the recording signal into recording laser beams of four colors, yellow, magenta, cyan, and black. Photosensitive drums 316 of corresponding colors are irradiated with the laser beams, and electrostatic latent images are formed on the corresponding photosensitive drums 316. Toner development is performed using toner supplied from a toner cartridge 317. Primary transfer of a visualized image is performed onto an intermediate transfer belt 321. Then, the intermediate transfer belt 321 rotates clockwise. When a recording sheet supplied through a sheet conveying path 319 from a sheet cassette 318 or the sheet supply deck 314 reaches a secondary transfer position 320, the image is transferred from the intermediate transfer belt 321 to the recording sheet. A fixing unit 322 fixes, by pressurization and heating, the toner onto the recording sheet on which the image has been transferred, and the recording sheet is conveyed through a sheet ejection path. Then, the recording sheet is conveyed to a face-down center tray 323, is switched back and conveyed to a sheet ejector 324 leading to the finisher 315, or is conveyed to a face-up sheet ejector 325. In a case where the finisher 315 is not installed, the face-up sheet ejector 325 is used for sheet ejection to a side tray that is attached to a leading edge of the sheet ejector 325.

In accordance with a function designated by a user, the finisher 315 performs post-processing for a printed sheet. More specifically, the finisher 315 has a stapling function (single-position stapling or two-position stapling), a punching function (two-hole punching or three-hole punching), a saddle-stitch binding function, and the like. The multifunction machine shown in FIG. 3 includes two sheet output trays 328. A recording sheet conveyed through the sheet ejector 324, which leads to the finisher 315, is distributed to one of the sheet output trays 328 according the function, such as copying, printing or facsimile, set by the user. For example, in a case where the multifunction machine is used as a printer, various settings, such as monochrome/color printing, the sheet size, 2-up/4-up/N-up printing, duplex printing, stapling, punching, saddle-stitch binding, a slip sheet, a cover sheet, a back cover sheet, and the like, can be performed using a driver.

The image forming apparatus 102 includes a plurality of sensors for detecting the presence of a sheet. For example, the sheet output trays 328 each include a sheet output sensor. With the sheet output sensors, the controller unit 200 is capable of determining, for example, where to output a sheet.

Monitoring Camera

The monitoring camera 103 is installed, for example, at the rear and above the image forming apparatus 102, so as to capture a video image of a user who operates the image forming apparatus 102. A video image captured by the monitoring camera 103 is transferred to the monitoring system control apparatus 104 and is stored in the monitoring system control apparatus 104. Although the monitoring camera 103 is connected to the monitoring system control apparatus 104 through the network (LAN) 101 in this embodiment, the monitoring camera 103 may be directly connected to the monitoring system control apparatus 104.

Monitoring System Control Apparatus

The monitoring system control apparatus 104 controls the monitoring system. In this embodiment, the control of the monitoring system is implemented in accordance with an application program running on a general PC including an HDD for recording data, a network I/F, and the like. In addition, the monitoring system control apparatus 104 is connected to an external apparatus through the network (LAN) 101 in this embodiment. However, the monitoring system control apparatus 104 may be implemented on the controller unit 200 of the image forming apparatus 102. Alternatively, Java implementation environment may be implemented on the image forming apparatus 102, so that the monitoring system can be implemented as a Java program.

First Embodiment

Figure 4:
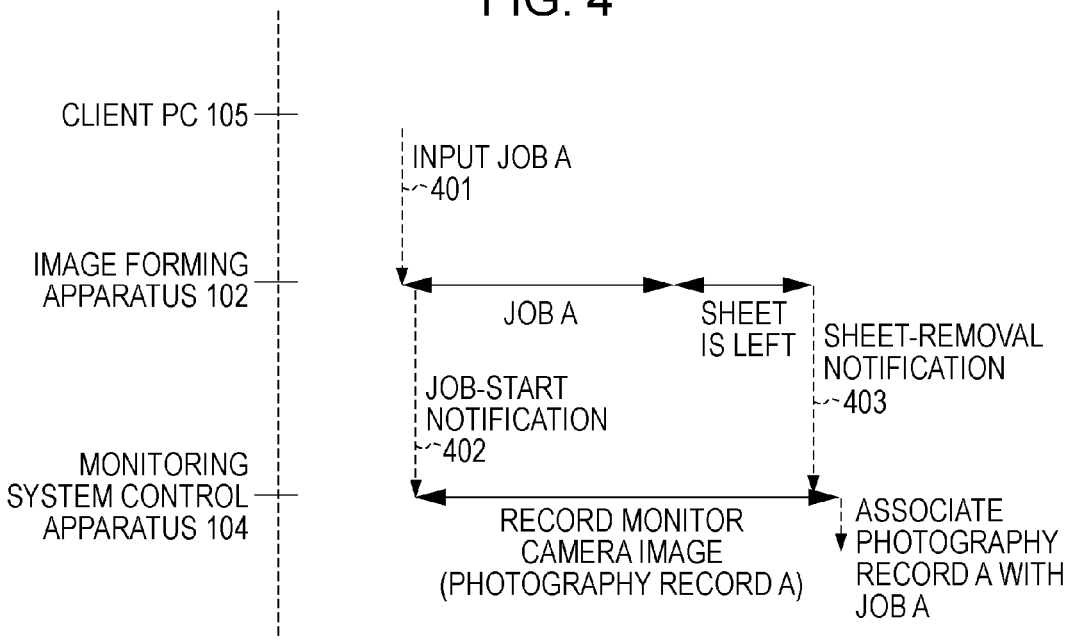
FIG. 4 is a sequence diagram showing a monitoring method according to a first embodiment of the present invention.

A control method according to a first embodiment will be described with reference to a sequence diagram of FIG. 4. The client PC 105 transmits a print job to the image forming apparatus 102 (401), and the image forming apparatus 102 starts processing for the job. Then, the image forming apparatus 102 transmits a job-start notification to the monitoring system control apparatus 104 (402). The job-start notification contains device information identifying an image forming apparatus and job information identifying a job. In the case of a copy job, a job-start notification contains device information and the type of the job (copy). In the case of a facsimile job, a job-start notification contains device information and the type of the job (facsimile). In the case of a print job, a job-start notification contains device information, the type of the job (print), and job-owner information (the name of a client PC and a user ID).

When receiving the job-start notification (402), the monitoring system control apparatus 104 starts recording of a video image captured by the monitoring camera 103. The image forming apparatus 102 performs processing for the print job, supplies a formed image to a sheet output portion, and ends the image forming operation. Then, after the sheet is removed by a user, a sheet output sensor detects the removal of the sheet. The image forming apparatus 102 transmits a sheet-removal notification to the monitoring system control apparatus 104 (403). When receiving the sheet-removal notification (403), the monitoring system control apparatus 104 stops recording of a video image captured by the monitoring camera 103. The recorded video image is stored, in association with device information and job information contained in the job-start notification, into the HDD.

The monitoring camera 103 always captures a video image near the monitoring system control apparatus 104. The monitoring system control apparatus 104 acquires the video image and records the acquired video image. The monitoring system control apparatus 104 may instruct the monitoring camera 103 to start or end capturing of a video image.

In the case of a copy job, the image forming apparatus 102 may transmit a job-start notification when a user presses a start key and processing for the job starts. Accordingly, for a copy job, a control method can be achieved with a configuration similar to that for a print job.

As described above, starting and ending of recording of a video image captured by a monitoring camera can be determined in accordance with a notification received from a device, and the acquired video image can be managed in association with job attribute information contained in the notification.

Second Embodiment

Figure 5:
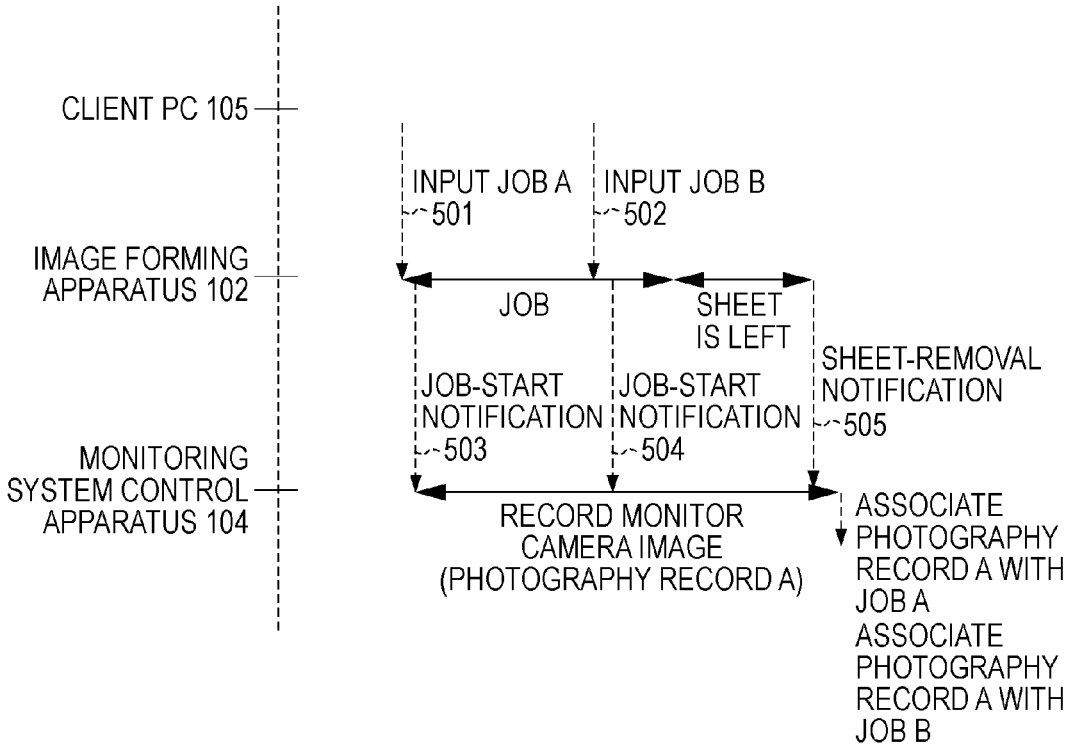
FIG. 5 is a sequence diagram showing a monitoring method according to a second embodiment of the present invention.

Although a method for managing the image forming apparatus 102 in a case where a single job is input has been described in the first embodiment, a case where jobs are sequentially input and output sheets are kept in a sheet output portion will be described in a second embodiment. As shown by a sequence diagram of FIG. 5, in a case where job A and job B are sequentially input (501 and 502), job-start notifications for the job A and the job B are transmitted to the monitoring system control apparatus 104 (503 and 504). A sheet-removal notification (505) is transmitted when both the output sheets for the job A and the job B are removed. A process performed by the monitoring system control apparatus 104 in this case will be described with reference to FIG. 6.

When receiving a notification from the image forming apparatus 102 in step S601, the monitoring system control apparatus 104 determines whether the received notification is a sheet-removal notification in step S602. If it is determined in step S602 that the received notification is not a sheet-removal notification (that is, the received notification is a job-start notification), the monitoring system control apparatus 104 internally registers, as information to be managed, attribute information of job n in step S603. In the example shown in FIG. 5, "n" represents A or B. Then, the monitoring system control apparatus 104 determines whether the received notification is a first notification in step S604. If it is determined in step S604 that the received notification is a first notification, the monitoring system control apparatus 104 starts recording of a video image transmitted from the monitoring camera 103 in step S605. Then, the monitoring system control apparatus 104 waits for the next notification. If it is determined in step S604 that the received notification is not a first notification, the monitoring system control apparatus 104 waits for the next notification.

If it is determined in step S602 that the received notification is a sheet-removal notification, the monitoring system control apparatus 104 stops recording of a video image in step S606. Then, in step S607, the recorded video image and attribute information of the job are stored in association with each other in the monitoring system control apparatus 104. All the images to be associated with attribute information are the same and are received during the period from the reception of the first job-start notification (503) to the reception of the sheet-removal notification (505).

Third Embodiment

In the first and second embodiments, a job-start notification is used as a trigger for starting recording of a video image. However, by changing a start trigger to delay the video-image-capturing start time in accordance with the attribute of a job, the time required for identifying, in accordance with a video image, a scene in which a user removed an output sheet can be shortened. Thus, the size of a video image file can be reduced, and the efficiency of video image management can be improved. In a third embodiment, an example in which a start trigger is changed according to the type of finishing will be described with reference to a flowchart shown in FIG. 7.

Figure 6:
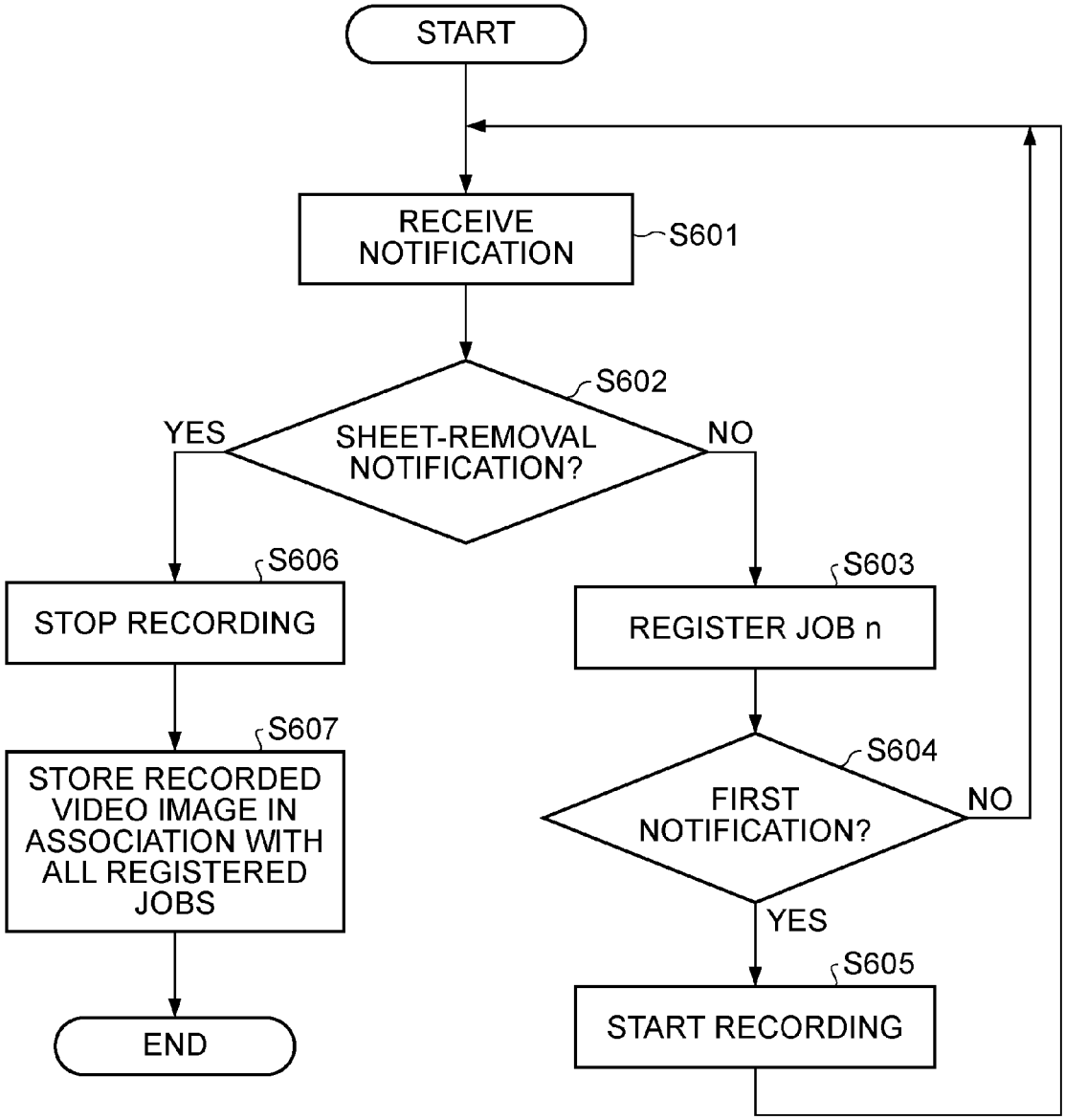
FIG. 6 is a flowchart showing a process of the monitoring method according to the second embodiment.
Figure 7:
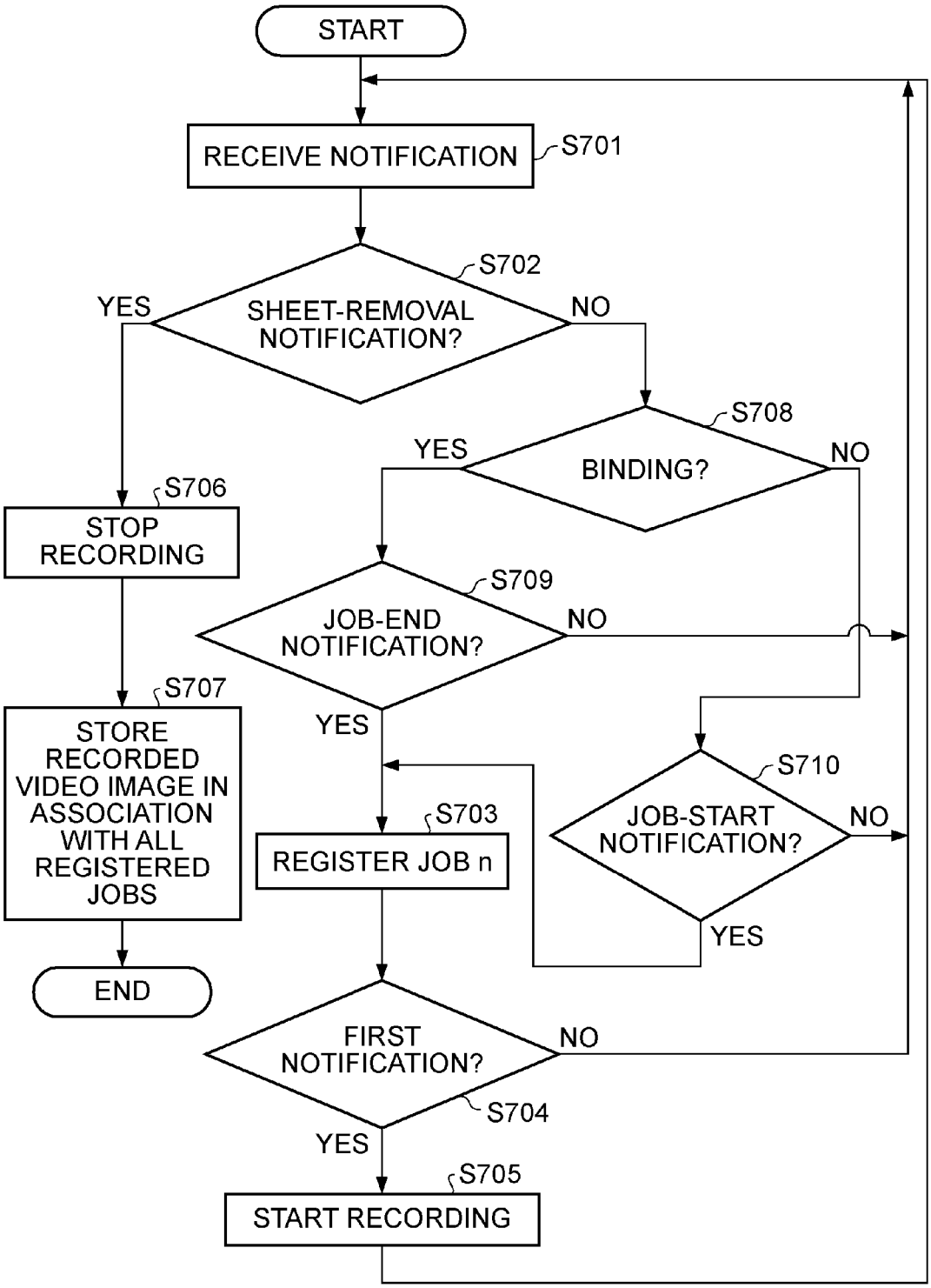
FIG. 7 is a flowchart showing a process of a monitoring method according to a third embodiment of the present invention in which the type of finishing of a job is taken into consideration.

FIG. 7 is a flowchart obtained by expanding the flowchart shown in FIG. 6 according to the second embodiment.

When receiving a notification in step S701, the monitoring system control apparatus 104 determines whether the received notification is a sheet-removal notification in step S702. If it is determined in step S702 that the received notification is a sheet-removal notification, the monitoring system control apparatus 104 stops recording of a video image in step S706, and the recorded video image and attribute information of a job are stored in association with each other in the monitoring system control apparatus 104 in step S707, similarly to the flow shown in FIG. 6.

If it is determined in step S702 that the received notification is not a sheet-removal notification, the monitoring system control apparatus 104 analyzes the attribute information of the job and determines whether the type of finishing is binding in step S708. If it is determined in step S708 that the type of finishing is biding, the monitoring system control apparatus 104 determines whether the notification received in step S701 is a job-end notification in step S709. If it is determined in step S709 that the received notification is a job-end notification, the subsequent processing is performed as in the second embodiment. That is, the monitoring system control apparatus 104 internally registers, as information to be managed, attribute information of job n in step S703. Here, "n" represents a received job (in the second embodiment, "n" represents A or B). Then, the monitoring system control apparatus 104 determines whether the received notification is a first notification in step S704. If it is determined in step S704 that the received notification is a first notification, the monitoring system control apparatus 104 starts recording of a video image transmitted from the monitoring camera 103 in step S705. Then, the monitoring system control apparatus 104 waits for the next notification. If it is determined in step S704 that the received notification is not a first notification, the monitoring system control apparatus 104 waits for the next notification.

If it is determined in step S709 that the received notification is not a job-end notification, the monitoring system control apparatus 104 waits for the next notification.

If it is determined in step S708 that the type of finishing is not binding, the monitoring system control apparatus 104 determines whether the received notification is a job-start notification in step S710. If it is determined in step S710 that the received notification is a job-start notification, the monitoring system control apparatus 104 performs recording processing in steps S703 to S705. If it is determined in step S710 that the received notification is not a job-start notification, the monitoring system control apparatus 104 waits for the next notification.

The determination as to the type of finishing in step S708 may be a determination of whether job information contains a finishing attribute.

Although the case of binding has been described in the third embodiment, post-processing, such as stapling, may be performed as finishing.

As described above, by analyzing the attribute of a job, starting and ending of recording by a monitoring camera and storing of a recorded video image can be controlled in consideration of the type of finishing, such as binding. Thus, management of a video image captured by the monitoring camera can be efficiently achieved.

Fourth Embodiment

Figure 9:
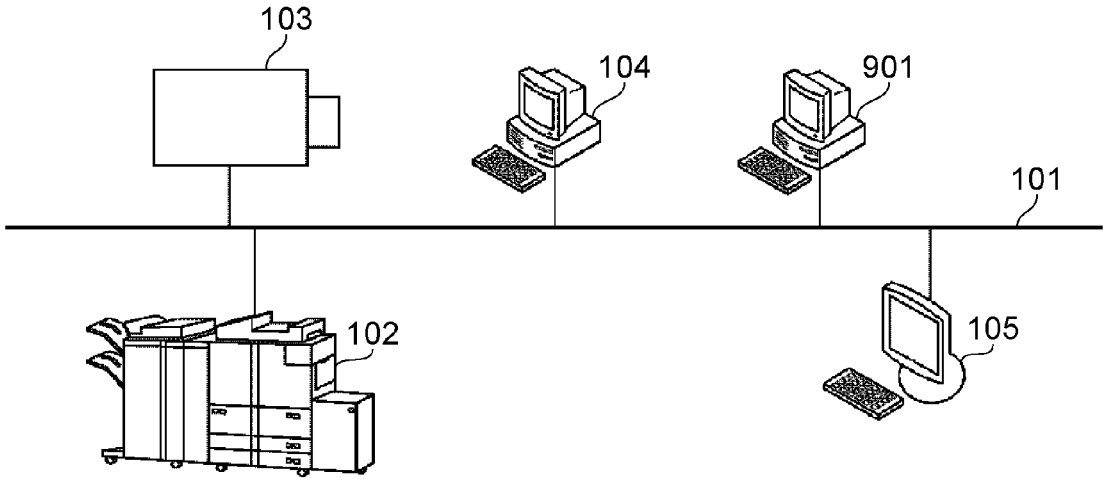
FIG. 9 shows the configuration of a system according to the fourth embodiment.

In the first to third embodiments, in order to manage an output material (printed sheet), job information and a video image captured by a monitoring camera are managed in association with each other. In a fourth embodiment, since owner information of a job, job information, and a video image are managed together, high-precision management can be achieved. FIG. 9 shows the configuration of a system according to the fourth embodiment. A user-information database 901 (for example, an employee DB) for managing owner information is disposed on the network (LAN) 101. Since parts other than the user information database 901 are the same as in FIG. 1, the description of those same parts will be omitted. For example, in a case where the user information database 901 is an employee DB, a department, a name, a facial portrait, an extension number, and a mail address are managed in association with a user ID.

Figure 8:
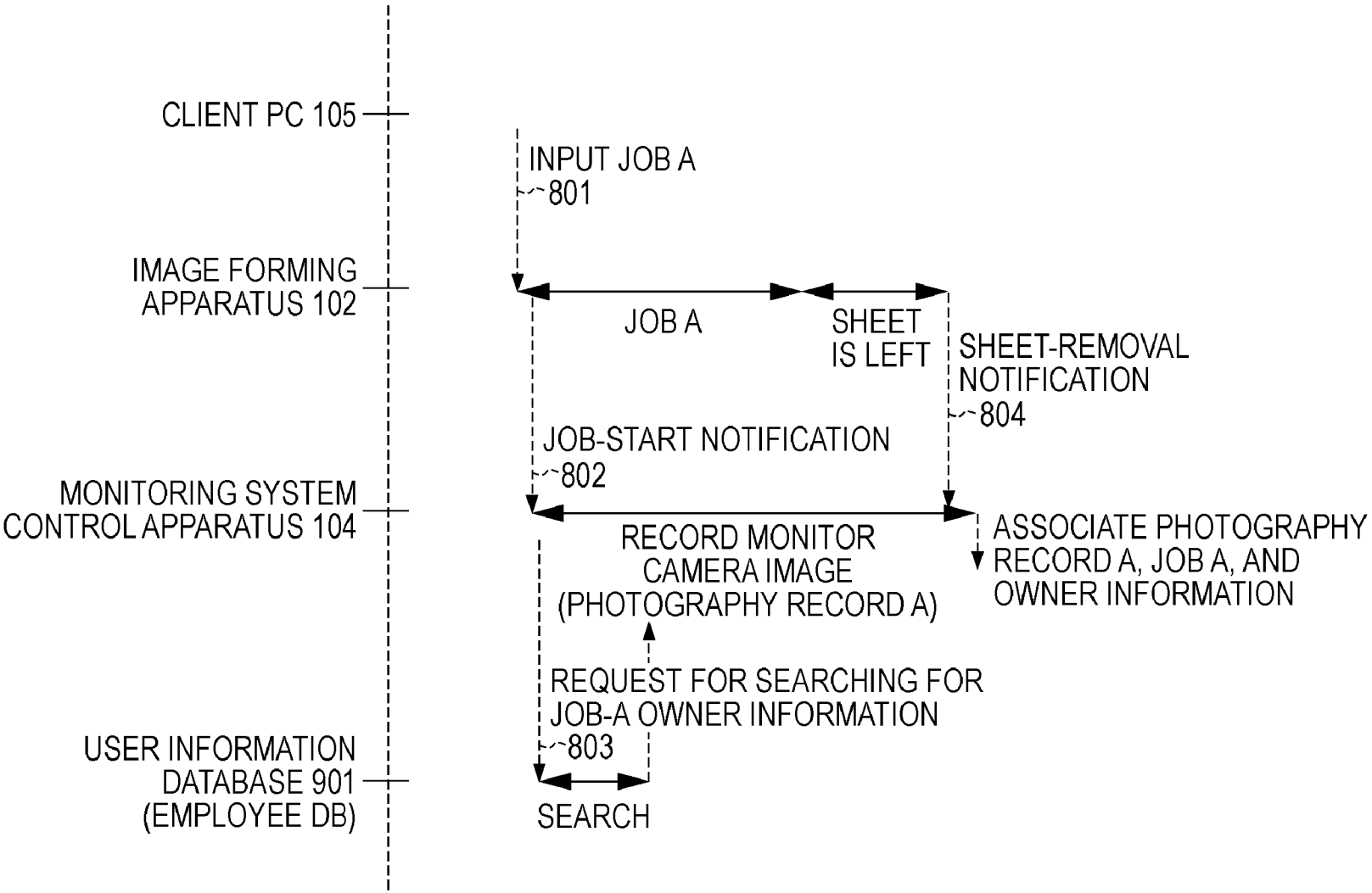
FIG. 8 is a sequence diagram showing a monitoring method for managing job information, a video image, and owner information according to a fourth embodiment of the present invention.

An example of a control method according to the fourth embodiment will be described with reference to a sequence diagram shown in FIG. 8. FIG. 8 is obtained by expanding FIG. 4. The client PC 105 inputs a job A to the image forming apparatus 102 (801). When receiving a job-start notification (802), the monitoring system control apparatus 104 starts recording of a video image captured by the monitoring camera 103. At the same time, when receiving the job-start notification for the job A (802), the monitoring system control apparatus 104 extracts owner information from attribute information of the job and queries the employee DB as to information on the owner of the job (803). Job-owner information contains the name of a client PC and a user ID. Normally, a user ID is a login ID used for entry for a network domain. Thus, the monitoring system control apparatus 104 is capable of acquiring job-owner information, such as a department, a name, and a facial portrait, by querying the user-information database 901 (the employee DB) as to user information. That is, when the monitoring system control apparatus 104 transmits a user-information search request to the user-information database 901 (the employee DB) (803), the user-information database 901 searches for user information of the corresponding user ID. Then, the user-information database 901 transmits a search result to the monitoring system control apparatus 104. The user information, which serves as a search result, contains a department, a name, a facial portrait, an extension number, and a mail address corresponding to the user ID.

The image forming apparatus 102 performs processing for the print job, and a formed image output is transmitted to a sheet output portion. After the output sheet is removed by a user, a sheet output sensor detects the removal of the output sheet. Then, the image forming apparatus 102 transmits a sheet-removal notification to the monitoring system control apparatus 104 (804). When receiving the sheet-removal notification (804), the monitoring system control apparatus 104 stops recording of a video image captured by the monitoring camera 103. The captured video image (photography record A) is stored in association with device information, job information, and job-owner information contained in the job-start notification into the HDD of the monitoring system control apparatus 104.

Finally, the monitoring system control apparatus 104 stores job information, a video image captured by the monitoring camera 103, and owner information together. If owner information contains image information, such as a facial portrait of an owner, comparison between the facial portrait and a person who appears in the stored video image can be performed.

Accordingly, higher-level management of information on an output job and a video image captured by a monitoring camera can be achieved.

Other Embodiments

Embodiments of the present invention may be embodied, for example, as a system, an apparatus, a method, a program, a storage medium, or the like. More specifically, embodiments of the present invention may be applied to a system including a plurality of apparatuses or to an apparatus including a single device.

According to aspects of the present invention, functions of the foregoing embodiments can be attained when software programs are supplied to a system or an apparatus directly or via remote control and when a computer of the system or the apparatus reads and executes supplied program code. In this case, the supplied programs correspond to flowcharts represented in the foregoing embodiments.

Thus, in order to implement functional processing of an aspect of the present invention, a program code itself installed into the computer also implements embodiments of the present invention. That is, a computer program itself for attaining functional processing of an aspect of the present invention falls within the scope of the present invention.

In this case, the computer program may be of any type, such as an object code, a program to be executed by an interpreter, or script data to be supplied to an operating system (OS), as long as it has a function of a program.

As a recording medium for supplying a program, for example, a floppy disk, a hard disk, an optical disc, a magneto-optical disk (MO), a compact disc read-only memory (CD-ROM), a compact disc recordable (CD-R), a compact disc rewritable (CD-RW), a magnetic tape, a non-volatile memory card, a ROM, or a digital versatile disc (DVD) (including a DVD-ROM and a DVD-R) is available.

In addition, the program may be obtained by connecting to a website on the Internet using a browser of a client computer and by downloading a computer program according to an aspect of the present invention from the website to a storage medium, such as a hard disk. In this case, the program to be downloaded may be a compressed file having an automatic installation function. In addition, the program may be supplied by dividing the program code constituting the program according to an aspect of the present invention into a plurality of files and by downloading the divided files from different websites. That is, a World Wide Web (WWW) server for allowing a plurality of users to download a program file for attaining functional processing of an aspect of the present invention on a computer is also included in the present invention.

In addition, a program according to an aspect of the present invention may be encoded and stored in a storage medium, such as a CD-ROM, and may be distributed to users. Only a user who satisfies predetermined conditions may be able to download key information for decoding the encoded program from a website via the Internet. In addition, the encoded program can be executed by using the downloaded key information and can be installed to a computer.

In addition, the functions of the foregoing embodiments can be attained not only when the read program is executed by the computer but also when part or all of the actual processing is performed in cooperation with an operating system (OS) or the like running on the computer on the basis of instructions of the program. In this case, the OS or the like performs part or all of the actual processing and the functions of the foregoing embodiments can be attained by the processing.

Furthermore, the program read from the recording medium may be written to a memory arranged in a function expansion board inserted into the computer or a function expansion unit connected to the computer. The functions of the foregoing embodiments can also be attained when part or all of the actual processing is performed by the CPU or the like arranged in the function expansion board or the function expansion unit on the basis of instructions of the program after the program is written to the function expansion board or the function expansion unit.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2007-029354 filed Feb. 8, 2007, which is hereby incorporated by reference herein in its entirety.

What is claimed is:

1. A monitoring apparatus connected to a monitoring camera capable of monitoring a user of an image forming apparatus through a communication medium, the monitoring apparatus comprising:

a job-start-notification reception unit configured to receive a job-start notification from the image forming apparatus;

a sheet-removal-notification reception unit configured to receive a sheet-removal notification indicating that the user obtains a printed sheet output to a sheet output portion of the image forming apparatus from the image forming apparatus;

an acquiring unit configured to acquire, based on owner information contained in a job to be processed by the image forming apparatus, information on an owner who requests for processing the job from a storage unit;

a monitor-video-image recording unit configured to acquire a video image captured by the monitoring camera and to record the acquired video image as a monitor video image;

an instruction unit configured to instruct the monitor-video-image recording unit to start recording a video image in a case where the job-start-notification unit receives the job-start notification, and to instruct the monitor-video-image recording unit to stop recording the video image in a case where the sheet-removal-notification reception unit receives the sheet-removal notification; and a managing unit configured to manage the video image recorded according to an instruction from the instruction unit, the information on the job processed by the image forming apparatus and the information on the owner acquired by the acquiring unit in association with each other.

2. The monitoring apparatus according to claim 1, wherein the acquiring unit acquires a department, a name, a facial portrait, an extension number and a mail address of the owner, as the information on the owner, wherein the managing unit manages the department, the name, the facial portrait, the extension number and the mail address of the owner, as the information on the owner, and wherein the facial portrait is used for comparison with a user in the video image recorded according to the instruction from the instruction unit.

3. The monitoring apparatus according to claim 2, wherein the instruction unit gives an instruction to start recording a video image in a case where the job-start-notification reception unit receives a first job-start notification, wherein the instruction unit does not give either an instruction to start recording the video image or an instruction to stop recording the video image in a case where the job-start-notification reception unit receives a second or subsequent job-start notification by the time when the sheet-removal-notification reception unit receives the sheet-removal notification, wherein the instruction unit gives an instruction to stop recording the video image in response to reception by the sheet-removal-notification reception unit of the sheet-removal notification indicating that a user obtains printed sheets corresponding to all jobs processed by the image forming apparatus, and wherein the managing unit manages information on the jobs processed by the image forming apparatus and the video image recorded according to an instruction from the instruction unit in association with each other.

4. The monitoring apparatus according to claim 3, wherein the instruction unit gives an instruction to start recording a video image when the instruction unit receives a job end notification from the image forming apparatus, and the instruction unit gives an instruction to stop recording the video image when the sheet-removal-notification reception unit receives the sheet-removal notification, in a case where the instruction unit receives information indicating a job to be post-processed by the job-start-notification unit.

5. The monitoring apparatus according to claim 1, wherein the job to be processed by the image forming apparatus is a print job.

6. A control method for a monitoring apparatus connected to a monitoring camera capable of monitoring a user of an image forming apparatus through a communication medium, the control method comprising:

receiving, using a job-start-notification reception unit, a job-start notification from the image forming apparatus;

receiving, using a sheet-removal-notification reception unit, a sheet-removal notification indicating that the user obtains a printed sheet output to a sheet output portion of the image forming apparatus from the image forming apparatus;

acquiring, based on owner information contained in a job to be processed by the image forming apparatus, information on an owner who requests for processing the job from a storage unit, wherein the acquiring step is executed using an acquiring unit;

acquiring, using a monitor-video-image recording unit, a video image captured by the monitoring camera;

recording, using the monitor-video-image recording unit, the acquired video image as a monitor video image;

instructing, using an instruction unit, the monitor-video-image recording unit to start recording a video image in a case where the job-start-notification unit receives the job-start notification, and instructing the monitor-video-image recording unit to stop recording the video image in a case where the sheet-removal-notification reception unit receives the sheet-removal notification; and managing, using a managing unit, the video image recorded according to an instruction from the instruction unit, the information on the job processed by the image forming apparatus and the information on the owner acquired by the acquiring unit in association with each other.

7. The control method according to claim 6, wherein, in the step of acquiring information on the owner, the acquiring unit acquires a department, a name, a facial portrait, an extension number and a mail address of the owner, as the information on the owner, wherein, in the managing step, the managing unit manages the department, the name, the facial portrait, the extension number and the mail address of the owner, as the information on the owner, and wherein the facial portrait is used for comparison with a user in the video image recorded according to the instruction from the instruction unit.

8. The control method according to claim 7, wherein, in the instructing step, the instruction unit gives an instruction to start recording a video image in a case where the job-start-notification reception unit receives a first job-start notification, wherein, in the instructing step, the instruction unit does not give either an instruction to start recording the video image or an instruction to stop recording the video image in a case where the job-start-notification reception unit receives a second or subsequent job-start notification by the time when the sheet-removal-notification reception unit receives the sheet-removal notification, wherein, in the instructing step, the instruction unit gives an instruction to stop recording the video image in response to reception by the sheet-removal-notification reception unit of the sheet-removal notification indicating that a user obtains printed sheets corresponding to all jobs processed by the image forming apparatus, and wherein, in the managing step, the managing unit manages information on the jobs processed by the image forming apparatus and the video image recorded according to an instruction from the instruction unit in association with each other.

9. The control method according to claim 8, wherein, in the instructing step, the instruction unit gives an instruction to start recording a video image when the instruction unit receives a job end notification from the image forming apparatus, and the instruction unit gives an instruction to stop recording the video image when the sheet-removal-notification reception unit receives the sheet-removal notification, in a case where the instruction unit receives information indicating a job to be post-processed by the job-start-notification unit.

10. The control method according to claim 6, wherein the job to be processed by the image forming apparatus is a print job.

11. A non-transitory computer-readable storage medium in which a program for causing a computer to execute a control method is stored, the control method for a monitoring apparatus connected to a monitoring camera capable of monitoring a user of an image forming apparatus through a communication medium, the control method comprising:

receiving, using a job-start-notification reception unit, a job-start notification from the image forming apparatus;

receiving, using a sheet-removal-notification reception unit, a sheet- removal notification indicating that the user obtains a printed sheet output to a sheet output portion of the image forming apparatus from the image forming apparatus;

acquiring, based on owner information contained in a job to be processed by the image forming apparatus, information on an owner who requests for processing the job from a storage unit, wherein the acquiring step is executed using an acquiring unit;

acquiring, using a monitor-video-image recording unit, a video image captured by the monitoring camera;

recording, using the monitor-video-image recording unit, the acquired video image as a monitor video image;

instructing, using an instruction unit, the monitor-video-image recording unit to start recording a video image in a case where the job-start-notification unit receives the job-start notification, and instructing the monitor-video-image recording unit to stop recording the video image in a case where the sheet-removal-notification reception unit receives the sheet-removal notification; and managing, using a managing unit, the video image recorded according to an instruction from the instruction unit, the information on the job processed by the image forming apparatus and the information on the owner acquired by the acquiring unit in association with each other.

12. The computer-readable storage medium according to claim 11, wherein, in the step of acquiring information on the owner, the acquiring unit acquires a department, a name, a facial portrait, an extension number and a mail address of the owner, as the information on the owner, wherein, in the managing step, the managing unit manages the department, the name, the facial portrait, the extension number and the mail address of the owner, as the information on the owner, and wherein the facial portrait is used for comparison with a user in the video image recorded according to the instruction from the instruction unit.

13. The computer-readable storage medium according to claim 12, wherein, in the instructing step, the instruction unit gives an instruction to start recording a video image in a case where the job-start-notification reception unit receives a first job-start notification, wherein, in the instructing step, the instruction unit does not give either an instruction to start recording the video image or an instruction to stop recording the video image in a case where the job-start-notification reception unit receives a second or subsequent job-start notification by the time when the sheet-removal-notification reception unit receives the sheet-removal notification, wherein, in the instructing step, the instruction unit gives an instruction to stop recording the video image in response to reception by the sheet-removal-notification reception unit of the sheet-removal notification indicating that a user obtains printed sheets corresponding to all jobs processed by the image forming apparatus, and wherein, in the managing step, the managing unit manages information on the jobs processed by the image forming apparatus and the video image recorded according to an instruction from the instruction unit in association with each other.

14. The computer-readable storage medium according to claim 13, wherein, in the instructing step, the instruction unit gives an instruction to start recording a video image when the instruction unit receives a job end notification from the image forming apparatus, and the instruction unit gives an instruction to stop recording the video image when the sheet-removal-notification reception unit receives the sheet-removal notification, in a case where the instruction unit receives information indicating a job to be post-processed by the job-start-notification unit.

15. The computer-readable storage medium according to claim 11, wherein the job to be processed by the image forming apparatus is a print job.

* * * * *